United States Patent [19]

Cunningham

[11] Patent Number: 4,543,469

[45] Date of Patent: Sep. 24, 1985

[54] GROUNDING ARRANGEMENT FOR METAL SHEATHED HEATING ELEMENT HAVING A PLASTIC MOUNTING MEMBER

[75] Inventor: Donald M. Cunningham, Pittsburgh, Pa.

[73] Assignee: Emerson Electric Co., St. Louis, Mo.

[21] Appl. No.: 371,668

[22] Filed: Apr. 26, 1982

[51] Int. Cl.[4] ..... H05B 3/82; F24H 1/20

[52] U.S. Cl. ..... 219/336; 219/316; 219/318; 219/322; 219/523; 219/536; 219/541

[58] Field of Search ..... 219/306, 310, 312, 314, 219/316, 318–322, 328, 331, 335, 336, 338, 523, 530, 526, 536, 542, 544, 541

[56] References Cited

U.S. PATENT DOCUMENTS

| | | | |
|---|---|---|---|
| 3,056,879 | 10/1962 | Fischer | 219/336 X |
| 3,217,138 | 11/1965 | Drugmand | 219/318 X |
| 3,525,849 | 8/1970 | Bleckmann | 219/336 X |
| 3,860,787 | 1/1975 | Strobach | 219/336 |
| 3,899,658 | 8/1975 | Yartz | 219/336 X |
| 3,943,328 | 3/1976 | Cunningham | 219/316 X |
| 4,152,578 | 5/1979 | Jacobs | 219/318 X |
| 4,210,799 | 7/1980 | Dzaack | 219/541 |

FOREIGN PATENT DOCUMENTS

| | | | |
|---|---|---|---|
| 1112792 | 8/1961 | Fed. Rep. of Germany | 219/336 |
| 668293 | 9/1964 | Italy | 219/336 |
| 1234030 | 6/1971 | United Kingdom | 219/335 |
| 2022380 | 12/1979 | United Kingdom | 219/318 |

*Primary Examiner*—A. Bartis

*Attorney, Agent, or Firm*—Polster, Polster and Lucchesi

[57] ABSTRACT

An electric metallic sheathed immersion heating element adapted to be mounted on the metal wall of a fluid tank with the active heating portion of the element extending through an opening in the tank wall into the contents thereof includes a rigid plastic mounting member fixed to the terminal portion of the heating element and adapted to be connected to the tank wall at the opening to operatively support the heating element on the tank. The rigid plastic mounting member may be formed as a molded plastic plug having an exterior screw thread adapted to engage a cooperative screw thread on the tank wall or as a flat plate adapted to be bolted to the exterior surface of the tank wall. In order to reduce corrosive erosion of the heating element sheath, the sheath is grounded to the metal tank wall by a U-shaped grounding member formed of a thin-gauge cold-rolled steel. The bight of the member overlies the outer surface of the mounting member and is electrically connected to the heating element sheath by crimping, while the legs of the member extend in the direction of the tank wall on opposite sides of the grounding member and are of sufficient length to resiliently electrically engage the tank wall when the heating element is operatively mounted in the tank opening by the mounting member. To limit galvanic current flow, the bight and legs of the grounding member are electrically isolated and a current limiting resistor is interposed in series therebetween. The grounding member is formed of thin-gauge cold-rolled steel and is of a U-shape. The bight of the member is electrically connected to the sheath of the heating element and the legs are adapted to be pressed against a metal ring welded to the tank to electrically connect the sheath to the tank, the latter in customary manner being grounded. To limit flow of galvanic current, the bight and legs of the grounding member are electrically isolated and a current limiting resistor is interposed in series therebetween.

20 Claims, 8 Drawing Figures

GROUNDING ARRANGEMENT FOR METAL SHEATHED HEATING ELEMENT HAVING A PLASTIC MOUNTING MEMBER

BACKGROUND AND SUMMARY

Electric heaters for water tanks are well known in the art and generally comprise a metal sheathed heater of hairpin formation with a metal mounting member connected across the two legs of the sheath. The mounting member was either a plate which was bolted to the tank wall, or a screw plug which was threaded into a fitting on the tank wall. At the present time, the manufacturers of water tanks prefer the screw-plug type of mounting member. Metal screw plugs heretofore used are relatively costly to produce, and they tend to corrode after a period of use and then are difficult to remove from the tank.

Screw plugs formed of a plastic material have many advantages over the metal plug since they are less costly to produce and are free of corrosive problems. However, since such plugs tend to electrically isolate the heating element from the water tank, a grounding member must be incorporated; otherwise, corrosive erosion of the sheath will occur after a period of use.

The mounting structure disclosed in the said Jacobs patent eliminated the disadvantages of the metal screw plug and provided an efficient mounting member that was well received in the trade. However, because the grounding member in the Jacobs structure was assembled with the legs of the heater before molding, the mold cavity had to be contoured to accomodate the grounding member and this insert molding increased cost.

My invention retains the many advantages of the Jacobs structure but eliminates the need for a costly mold. A plastic plug is molded in a simple mold and then assembled with the legs of the heating element with a force fit. A grounding member in the form of a metal strip of U-shaped formation has its bight portion mechanically and electrically connected to the heating element legs, and the terminal portion of its legs adapted to engage the ring welded to the tank wall around the opening in the wall. A flange-type mounting plate may be used instead of the screw plug type mounting.

The heating element herein disclosed may be adapted to provide a controlled amount of galvanic current flow between the sheath of the heating element and the wall of the hot water tank, as disclosed in U.S. Pat. No. 2,723,340, issued Nov. 8, 1955, to A. C. Boggs et al., and in U.S. Pat. No. 2,810,815, issued Oct. 22, 1957, to H. C. Dicome, both of these patents being assigned to the assignee of the present application.

DESCRIPTION OF THE DRAWINGS

In the embodiment disclosed, the grounding member is formed of thin-gage cold rolled steel and is U-shaped. The bight of the member is electrically connected to the metal sheath of the heater and the legs are adapted to be pressed against the metal ring welded to the tank wall. When a resistor is used to limit flow of galvanic current, the bight and legs of the grounding member are electrically isolated, and a current-limiting resistor is interposed in series therebetween.

In the drawings accompanying this specification and forming a part of this application, there are shown, for purpose of illustration, several embodiments which my invention may assume, and in these drawings.

DESCRIPTION OF THE PREFERRED EMBODIMENT

Figure 1:
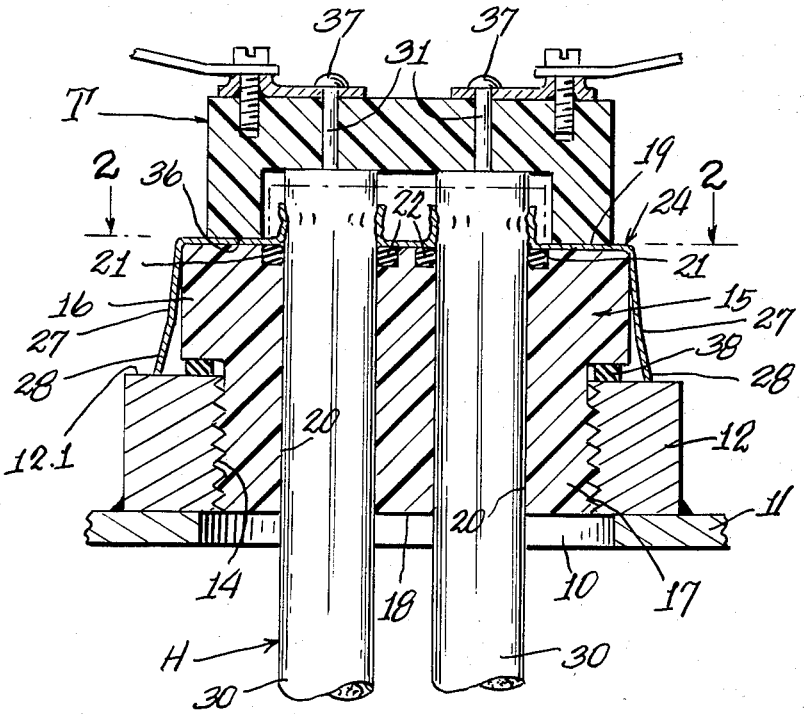
FIG. 1 is a fragmentary longitudinal sectional view of a heater construction illustrating the inventive concept of my invention.

The usual hot water tank is formed of relatively thin gauge steel so that sufficient screw threads cannot be formed in the margin of the heater hole 10 to adequately support a screw plug. Therefore, the usual practice is to weld a metal ring 12 to the outer surface of the tank wall 11 in axially aligned relation with the hole 10, the ring having internal screw threads 14.

The screw plug 15 is formed of a plastic material, preferably a glass reinforced plastic capable of withstanding high temperatures and offering greater resistance to creep on plastic deformation. Examples of suitable materials suitable for the purpose are Noryl made by General Electric Company, and Celcon made by the Celanese Corporation.

Since the plug 15 has no insert, it may be produced in a simple molding operation and in high quantities by use of plural cavity molds. In modern molding techniques very little, if any, flash is produced so that in many cases no trimming operation is necessary. The plug 15 is molded to provide a hex head 16 and an exteriorly threaded plug portion 17. The inner side 18 of the plug is exposed to the water in the tank and is termed the wet side, whereas the opposite side 19 of the plug is disposed away from the water in the tank and is termed the dry side.

Two round, longitudinally extending holes 20-20 are formed in the molding operation to extend from the wet side to the dry side of the plug, and shallow annular recesses 21 are formed in the dry side in concentric relation with each hole 20 and each is adapted to receive a sealing O-ring 22. The plug 15 is also formed with an elongated shallow recess 23 (see FIG. 3), extending from one flat of the head to the opposite flat, and across the dry side 19, as best seen in FIG. 3.

A grounding member 24 of sheet metal is formed in a stamping operation with a pair of extruded sleeves 25 in a flat center portion 26 and with downwardly-turned legs 27 at opposite ends of the center portion. The terminal portions of the legs 27 are angled slightly outwardly, as at 28. The grounding member 24 may be made from low-cost cold rolled steel having a thickness of 0.012 to 0.015 inches (about 0.396 millimeters). The width and thickness of the grounding member is such as to fit closely within the elongated shallow recess 23 formed in the dry side of the plug 15.

A conventional sheathed electric heating element H of hairpin shape forms part of the assembly, as does a conventional dielectric terminal block T. The heating element may be of the type shown in said Jacobs patent, and the terminal block may be of the type shown in U.S. Pat. No. 3,943,328, issued Mar. 9, 1976, to D. M. Cunningham and assigned to the assignee of the present application.

Figure 3:
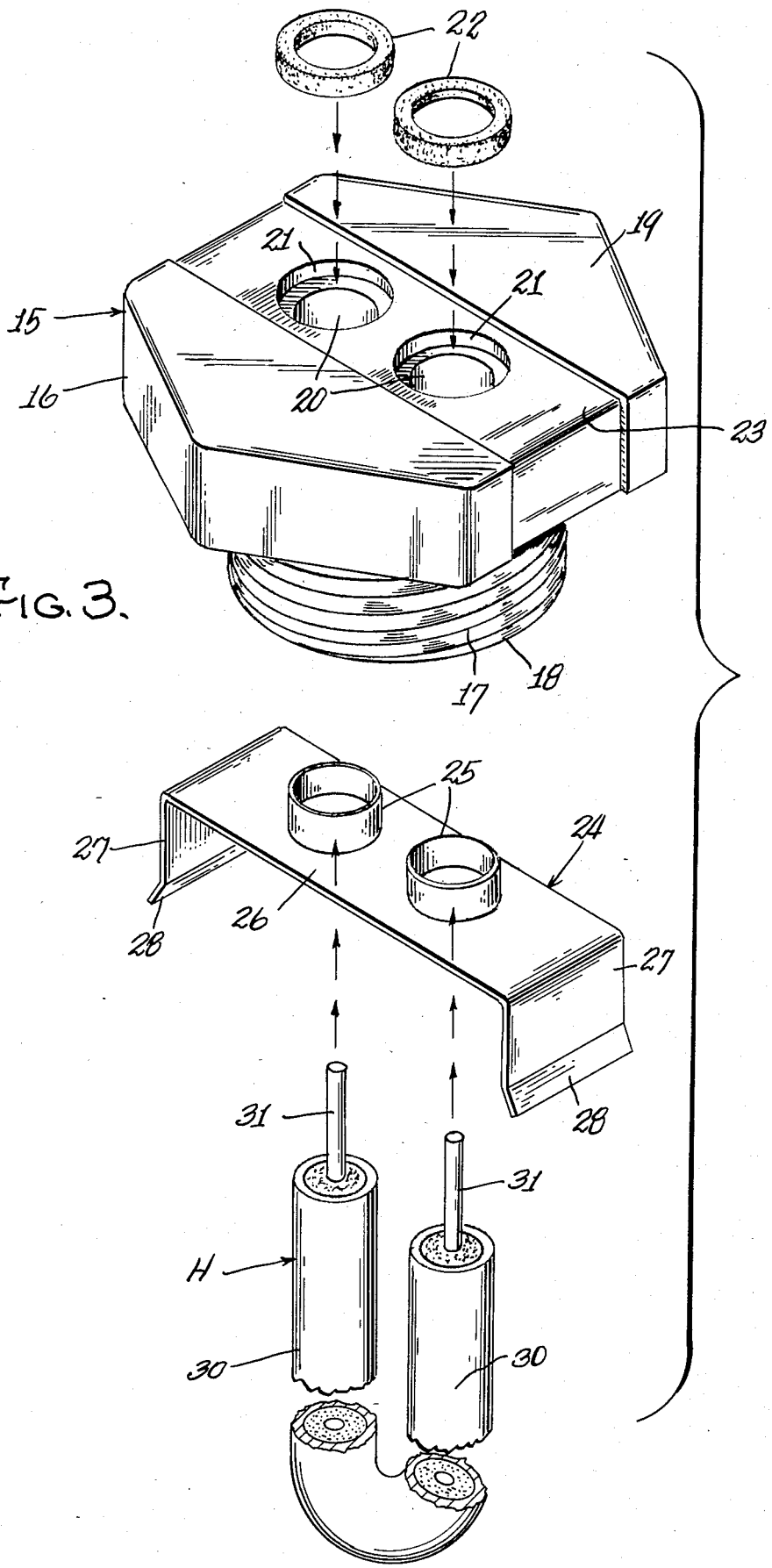
FIG. 3 is a separated, perspective view of parts of the assembly shown in FIGS. 1 and 2.

The ends 30-30 of the sheaths of the legs of the heating element are shown in FIGS. 1 and 3, with a terminal pin 31 extending outwardly of each end. The external diameter of the legs 30 is related to the diameter of the holes 20 in the plug to create an interference fit of about 0.002 to 0.003 inches therebetween.

The assembly of parts may be easily performed with unskilled labor and little tooling. The assembly operations may be performed in a sequence wherein the plug 15 and heating element are first assembled with the ends of the sheath legs extending from the dry side 19 of the plug a predetermined amount, as shown in FIG. 1. Tooling may be required for this assembly operation because of the interference fit mentioned previously. The O-rings 22 are assembled around the extending portion of each sheath leg and disposed within a respective annular recess 21. A slight interference fit is preferred to prevent unintentional displacement of the O-rings. No tooling is contemplated for this assembly step since the elastic nature of the O-rings should permit hand assembly.

The grounding member 24 is assembled with the extending portion of the sheath legs and disposed within the elongated shallow recess 23 and this may be a hand operation. Then the sleeves 25 are crimped firmly about the sheath legs and this would require tooling. Any suitable crimp may be made such as deforming the tubular sleeves 25 to a reduced, square shape as shown at 35 in FIG. 2. The terminal block T is assembled on the terminal pins 31 with the inner surface portion 36 firmly bearing against the flat center portion 26 of the grounding member 24 and the latter pressing against the O-rings 22. The terminal pins 31 are then headed over, as shown at 37, to maintain the assembly. This will also require tooling but the tooling in this case is already in existence for use in the assembly of prior water heaters.

A gasket 38 may be disposed over and around the threaded plug portion 17 and the latter may be threaded into the ring 12 which, as before pointed out, is welded to the wall of the water tank. The legs 27 of the grounding member 24 are of sufficient length so as to contact the outer surface 12.1 of the ring 12 before the plug 15 has been turned to its final home position so that the ends of the legs scrape over the surface 12.1 to cut through any corrosion thereon and to be sprung, as seen in FIG. 1, to insure a good grounding connection. The angled ends 28 of the legs 27 insure that the legs spring outwardly, rather than buckle. The compressed O-rings prevent leakage of water along the sheath legs from the wet side 18 to the dry side 19 of the plug, and the compressed gasket 38 prevents leakage of water along the interfitting threads of the ring 12 and plug portion 17.

Figure 4:
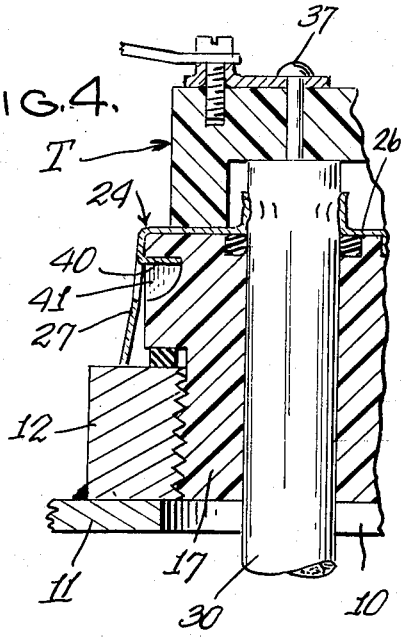
FIG. 4 is a fragmentary sectional view showing a slight modification.

The interference fit between the sheath legs 30 and the respective holes 20 in the plastic plug will prevent the legs from being pushed outwardly of the plug by pressure of the water in the tank. However, to guard against the possibility that the plastic of the plug may relax in time, a tank 40 (see FIG. 4) may be lanced out of a leg 27 of the grounding member 24 and confined within a hole 41 extending inwardly from a side surface of the head portion 19 of the plug.

DESCRIPTION OF OTHER EMBODIMENTS

Figure 6:
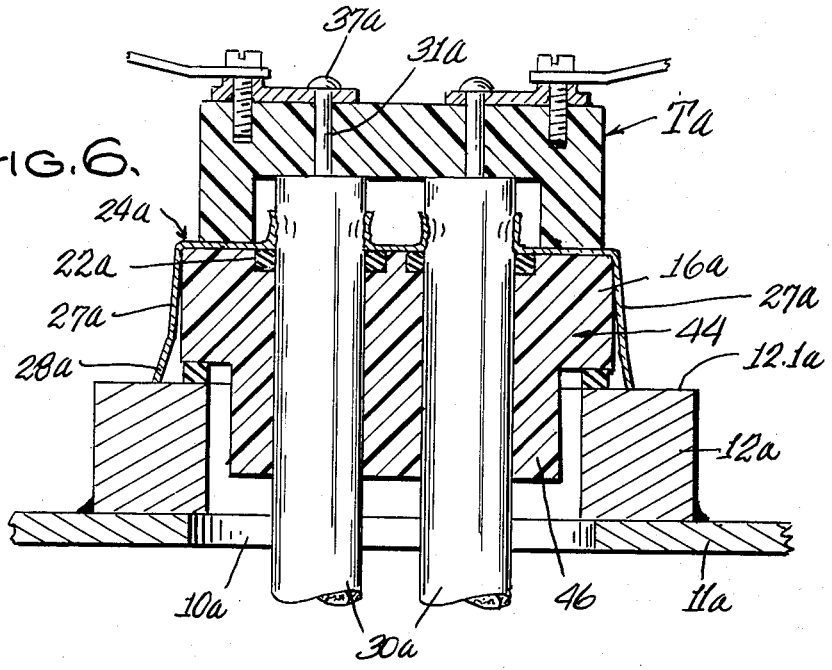
FIG. 6 is a fragmentary, longitudinal sectional view corresponding to the line 6—6 of FIG. 5.
Figure 5:
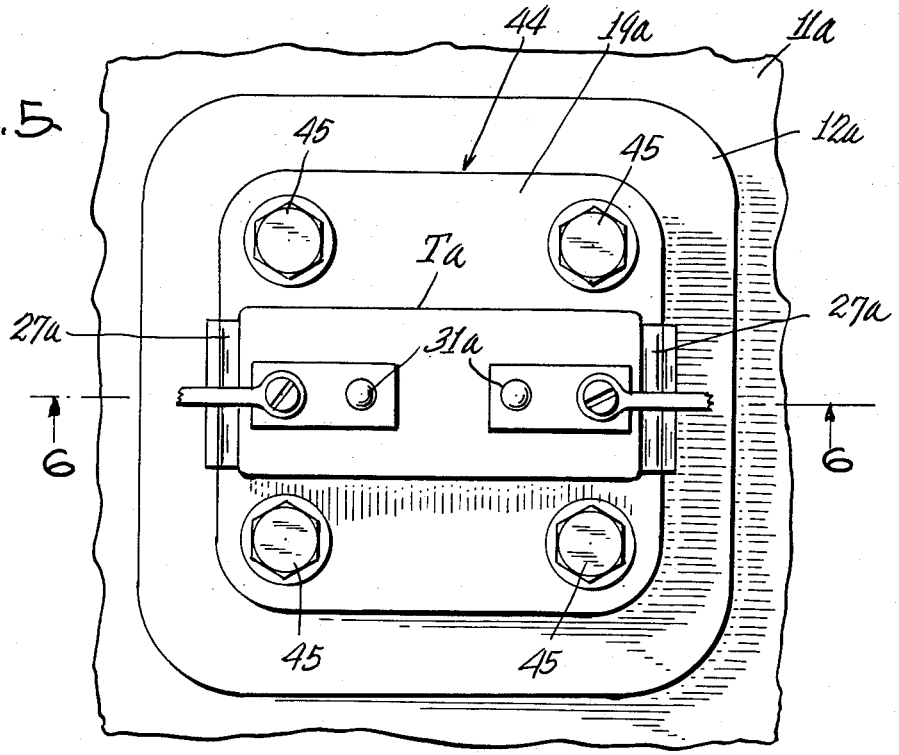
FIG. 5 is a top plan view showing my invention applied to a water heater having a mounting which is adapted to be bolted to the water tank.

Although, as previously mentioned, the water tank manufacturers presently prefer screw-type water heaters, my invention may also be applied to water heaters wherein the plastic support is in the form of a plate which is held to the tank wall by bolts. Attention is directed to FIGS. 5 and 6 wherein a heater of this type is disclosed, and wherein parts similar to those previously described are designated with the same reference numeral with the suffix "a" added.

The head **16*a* of the mounting 44 is preferably square, as viewed in plan in FIG. 5, with holes in its four corners to pass bolts 45 which are threaded into receiving holes formed in the ring 12*a* which is welded to the tank wall 11*a*. If the thickness of the head 16*a* is not sufficient to provide for a force fit with the sheath legs 30*a*, the head may be thickened inwardly, as seen at 46, to provide the required length. The legs 30*a*, the mounting 44, the O-rings 22*a*, the grounding member 24*a* and the terminal block Ta may be assembled in a manner such as described heretofore. When the bolts 45 are threaded home into the ring 12*a*, the ends of the legs 27*a* are engaged against the surface 12.1*a*** of the ring, and the legs are slightly sprung to maintain good grounding contact.

The plastic mounting members hereinbefore described provide many advantages over metal plugs in the matter of cost and anticorrosive qualities. Such mounting members also provide a direct ground between the sheath of the heating element and the wall of the tank. However, in some instances, an uncontrolled flow of galvanic current between the heater sheath and the tank wall caused rapid consumption of the magnesium rods normally installed in water tanks to protect the interior wall of the tank against corrosion in the event the protective lining on the interior wall proves faulty or develops pin holes.

Figure 2:
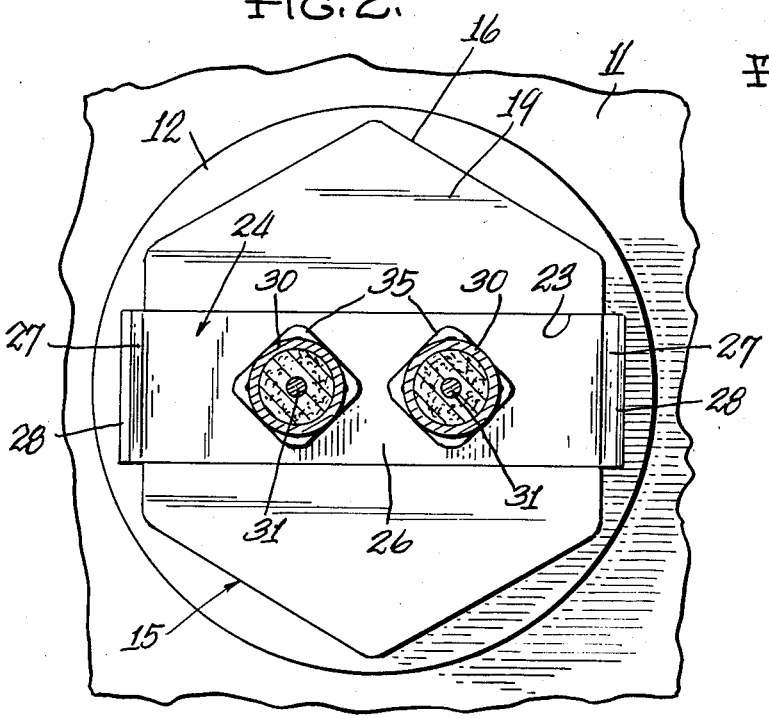
FIG. 2 is a fragmentary transverse sectional view corresponding to the line 2—2 of FIG. 1.
Figure 7:
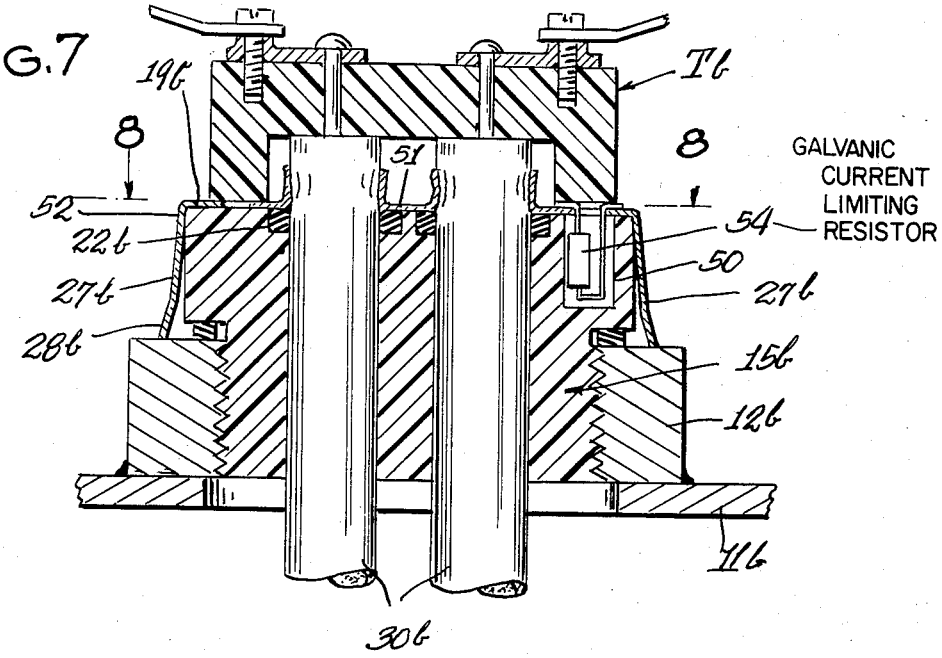
FIG. 7 is a fragmentary, longitudinal sectional view showing my invention applied to a heater which incorporates an electrical resistor to control flow of galvanic current.
Figure 8:
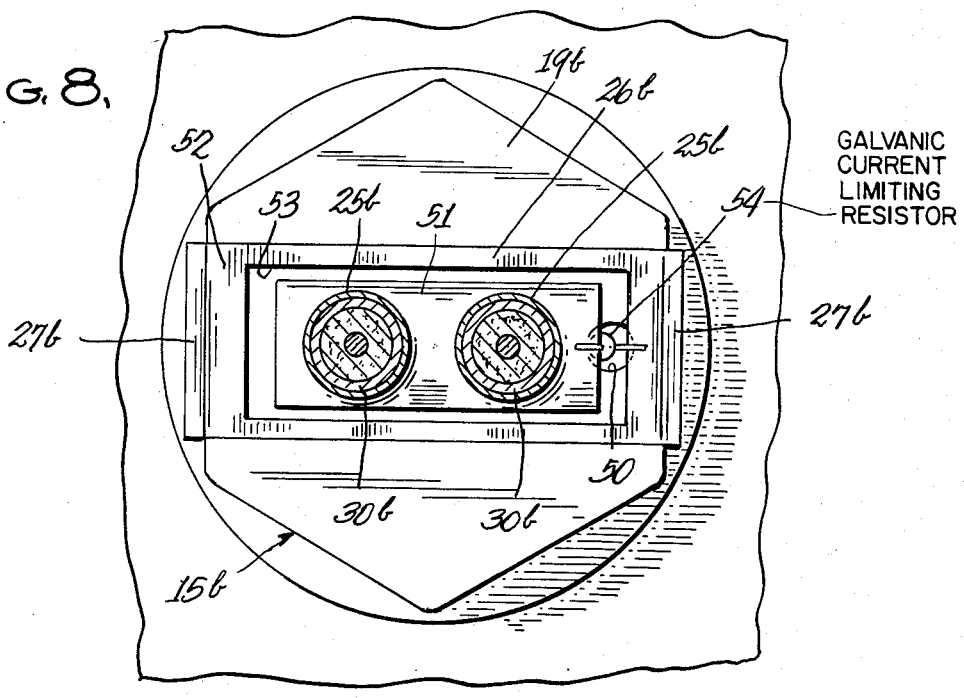
FIG. 8 is a fragmentary transverse sectional view corresponding to the line 8—8 of FIG. 7.

As mentioned before in the said Boggs and Dicome patents, the industry found certain advantages in providing a controlled amount of galvanic current flow between the sheath of heating element and the wall of the tank, and my invention makes it possible to provide for such controlled flow of galvanic current. Attention is directed to FIGS. 7 and 8 wherein a heater of this type is disclosed, and wherein parts similar to those described in connection with FIGS. 1, 2 and 3 are designated with the same reference numberal but with the suffix "b" added.

The plug **15*b* is like the screw plug 15 previously described, with the exception that a well 50 is formed to extend inwardly from the dry side 19*b* of the plug. The grounding member in this case is formed in two parts, one part 51 being flat and having the extruded sleeves 25*b* which are crimped about the legs 30*b* of the heating element. The other part 52 of the grounding member is complementary to the part 51 but is wider and has a rectangular opening 53 in its flat center portion 26*b*, to completely separate parts 51 and 52**.

A resistor 54 of predetermined fixed ohmage is disposed within the well 50. As seen in FIG. 7 the resistor is of the radio type and an ohmage found suitable in the said Boggs patent was 700 Ohms. Opposite leads of the resistor overlie respective surfaces of the parts 51 and 52, and are firmly pressed against such parts by the overlying portion of the terminal block Tb. Thus, the resistor provides for a controlled amount of galvanic current flow between the sheath of the heating element and the wall of the tank.

I claim:

1. In an electric heating element adapted to be mounted on the metal wall of a fluid container with an active heating portion extending through an opening in the wall for heating the contents of the container, said heating element comprising a metal sheath, an electrical resistance heating conductor longitudinally within said sheath, a thermally-conductive electrical insulation material supporting said resistance conductor within said sheath, and an electrical terminal conductor connected to an end of said resistance conductor at a terminal portion of said sheath and extending outwardly of an end of said sheath, the improvement comprising:

a plastic mounting member fixed to said sheath terminal portion, said mounting member being adapted for connection to the wall of the container to support said heating element in operative position with said active heating portion extending into the container, said mounting member being formed of a rigid plastic material whereby it needs no reenforcement to support said heating element, and, a metal grounding member having a first portion overlying an exterior surface of said mounting member and electrically connected to said sheath terminal portion, and an angularly-related second portion electrically connected to said first portion and extending in the direction of the tank wall, said second portion being of sufficient length to electrically engage the tank wall at the time said mounting member is operatively connected to the wall, to form an electrical connected between said sheath and the metal tank wall.

2. The construction according to claim 1 wherein (said) the tank on which the heating element is adapted to be mounted contains a liquid to be heated and wherein said mounting member when connected to the tank wall has a wet side exposed to the fluid within the tank and an opposite dry side, said mounting member having a hole therethrough extending from said wet side to said dry side, said sheath terminal portion extending through said hole with its end projecting from said dry side, said grounding member being electrically and mechanically connected to the projecting end of said sheath terminal portion.

3. The construction according to claim 2 wherein said sheath terminal portion extends through said hole with a force fit.

4. The construction according to claim 2 wherein an annular groove surrounds said hole at the dry side of said plug, and an O-ring seated within said groove, said first portion of said grounding member overlying said O-ring and holding the latter in sealing relation with the adjoining portion of said sheath terminal portion.

5. The construction according to claim 1 wherein said mounting member is a molded plastic plug having exterior threads adapted to engage interior screw threads on the tank wall.

6. The construction according to claim 1 wherein said mounting member is a plastic plate which is adapted to be bolted to the exterior surface of the tank wall.

7. The construction according to claim 1 wherein the tank on which said heating element is adapted to be mounted contains a liquid to be heated and said mounting member is a molded plastic plug and said heating element is of the hairpin type having a bight and a pair of legs in juxtaposed relation, and wherein said plastic plug has exterior screw threads adapted to engage interior screw threads on a metal ring welded to the exterior surface of the tank wall in axial alignment with the hole in the tank wall whereby said plug has a wet side exposed to the liquid in the tank and an opposite dry side outside of the tank, said plug having a pair of holes therethrough from the wet side to the dry side, each hole receiving the terminal portion of a respective heating element leg with an end of each leg extending beyond said dry side a predetermined amount, said grounding member being formed of a metal strip having a central portion forming said first portion and overlying said dry side and grounding legs defining said second portion and projecting from opposite ends of said central portion and shaped to be in spring engagement with the ring when said heating element is mounted in operative position on the tank, said central portion having a pair of extruded sleeves passing adjoining portions of said heater element legs and being crimped into electrical contact with the metal sheath at the terminal portions thereof.

8. The construction according to claim 7 wherein the liquid in the tank is under pressure, and wherein the terminal portion of a heating element leg extends through a respective hole in said plug with a force fit to restrict movement of said heating element in a direction outward of the tank by the pressure of the liquid in the tank.

9. The construction according to claim 7 wherein the liquid in the tank is under pressure, and wherein a projection from said grounding member seats in an aperture in said plug to restrict movement of said heating element in a direction outward of the tank by the pressure of the liquid in the tank.

10. The construction according to claim 1 wherein said grounding member is formed in two parts, one part forming said first portion and being electrically connected to said sheath and the other part forming said second portion adapted to electrically engage the tank wall when said mounting member is operatively connected to the tank wall, said parts being electrically isolated from each other, and a resistance member electrically connecting the two parts of said grounding member and adapted to control flow of galvanic current from the heating element sheath to the tank wall.

11. In an electric heating element having a metal sheath and adapted to be mounted on the metal wall of a water heater tank with an active heating portion extending through an opening in the wall of the tank and through an interiorly-threaded metal ring welded to the exterior surface of the tank wall and circumscribing the wall opening, said active heating portion being adapted for immersion in the water in the tank for heating the same, said heating element being of hairpin shape with a bight and a pair of legs extending from said bight in side-by-side manner, each leg having a terminal portion with a terminal pin extending from the end of said terminal portion, the improvement comprising:

a molded plastic plug having an exteriorly-threaded portion for threading into the metal ring whereby said plug has a wet side exposed to the liquid in the tank and an oppositely-disposed dry side forming the outwardly-directed transverse surface of a head portion having oppositely-disposed flat sides, said plug having a pair of side-by-side holes therethrough from said wet side to said dry side, each hole passing a respective one of said leg terminal portions, the end of each terminal portion extending from said outwardly-directed surface a predetermined amount, a grounding member in the form of a metal strip having a central flat portion overlying said outwardly-directed surface and a pair of grounding legs electrically connected to said central portion and extending toward the metal ring from opposite ends of said central portion and disposed flatwise along said oppositely-disposed flat sides of said head portion, and being of sufficient length to electrically engage the metal ring when said screw plug is screwed home in the metal ring, said central flat portion being electrically connected to the metal sheath of said terminal portions, and a terminal block of dielectric material having a pair of holes to pass respective terminal pins, the ends of said terminal pins being headed over an outwardly-directed surface of said terminal block so that an inwardly-directed surface of said terminal block is pressed against said central flat portion to in turn press the latter against said outwardly-directed surface of said plug head.

12. The construction according to claim 11 wherein said flat central portion of said grounding member is formed with a pair of side-by-side sleeves extruded therefrom and passing respective heater leg terminal portions and crimped in electrical contact with the metal sheath thereof.

13. The construction according to claim 12 wherein annular recesses are formed in said outwardly-directed surface of said plug, each recess circumscribing a respective hole in said plug, an O-ring of sealing material within each annular recess about the adjoining portion of each terminal portion of a heater leg, said central flat portion of said grounding member overlying and pressing against said O-rings.

14. The construction according to claim 11 wherein said central flat portion and said grounding legs are formed and assembled as electrically isolated parts, and a resistor electrically connects said flat portion and said grounding legs to control flow of galvanic current from said heating element sheath to the metal ring.

15. In an electric heating element adapted to be mounted on the metal wall of a liquid-containing tank, with an active heating portion extending through an interiorly-threaded opening in the tank wall for heating the liquid within the tank, said heating element comprising an elongated metal sheath, an electrical resistance heating conductor longitudinally within said sheath, a thermally-conductive electrical insulation material supporting said resistance conductor within said sheath, and an electrical terminal conductor connected to an end of said resistance conductor at a terminal portion of said sheath and extending outwardly from an end of said sheath, the improvement comprising:

a mounting member formed of rigid plastic, having an exteriorly-threaded plug portion adapted to be threaded into the opening in the tank, said sheath being carried by said mounting member and supported in operative position with said active heating portion extending into the tank when said plug portion has been screwed home in the opening in the tank, and means for grounding said sheath to the tank, including a first portion electrically connected to said sheath and an angularly related second portion electrically connected to said first portion, said second portion being offset with respect to the center of rotation of said plug portion, extending toward the tank wall, and being of sufficient length to engage the tank wall surrounding the opening therein as said plug portion is being screwed home to scrape against the tank wall in an arcuate path.

16. The construction according to claim 15 wherein said mounting member has a noncircular head portion structurally integral with and extending from said plug portion and adapted to receive a wrench for turning said plug home.

17. The construction according to claim 16 wherein said plug portion has a wet side exposed to the liquid in the tank and said head portion has a dry side opposite said wet side, said mounting member having a hole therethrough from said wet side to said dry side, said sheath terminal portion extending through said hole with its end projecting from said dry side.

18. The construction according to claim 17 wherein the liquid in the tank is under pressure, and wherein said mounting member has an annular groove extending inwardly from said wet side and of a larger diameter than and surrounding said hole in said mounting member, and an O-ring positioned within said annular groove and surrounding said sheath terminal portion, said O-ring being adapted to seal against flow of liquid through said mounting member hole.

19. The construction according to claim 17 wherein said grounding means first portion comprises a metal plate overlying said dry side of said head portion and having an opening through which said sheath terminal portion extends, said metal plate being fixed to said sheath terminal portion.

20. The construction according to claim 19 wherein said grounding means second portion comprises a leg of sufficient length to extend from said head portion and to engage the tank wall surrounding the tank opening before said plug portion is entirely screwed home.

* * * * *